United States Patent [19]

Geary

[11] 4,116,004

[45] Sep. 26, 1978

[54] HYDRAULIC PULSE GENERATING APPARATUS

[76] Inventor: William R. C. Geary, 4/18 Kensington Rd., South Yarra, Victoria, Australia, 3141

[21] Appl. No.: 724,535

[22] Filed: Sep. 20, 1976

Related U.S. Application Data

[62] Division of Ser. No. 549,053, Feb. 11, 1975, Pat. No. 3,988,828.

[51] Int. Cl.[2] ..... F15B 7/02

[52] U.S. Cl. ..... 60/543; 60/544; 60/583; 60/584; 60/586; 60/594

[58] Field of Search ..... 60/568, 584, 544, 594, 60/592, 569, 583, 591, 537, 586, 543

[56] References Cited

U.S. PATENT DOCUMENTS

| | | | |
|---|---|---|---|
| 2,168,806 | 8/1939 | Reilly | 60/544 |
| 2,246,348 | 6/1941 | Coffey | 60/586 |
| 2,323,770 | 7/1943 | Hazelton | 60/594 |
| 2,645,138 | 7/1953 | Mitchhart | 60/594 |
| 2,882,686 | 4/1959 | Griffith | 60/584 |
| 3,137,369 | 6/1964 | Stromberg | 60/586 |
| 3,286,465 | 11/1966 | Cerles | 60/568 |
| 3,863,681 | 2/1975 | Dostal | 60/537 |
| 3,930,434 | 1/1976 | Hunter | 91/36 |

FOREIGN PATENT DOCUMENTS

| | | | |
|---|---|---|---|
| 6,185 of | 1906 | United Kingdom | 60/594 |
| 934,942 | 8/1963 | United Kingdom. | |

*Primary Examiner*—Martin P. Schwadron
*Assistant Examiner*—Abraham Hershkovitz
*Attorney, Agent, or Firm*—Holman & Stern

[57] ABSTRACT

Hydraulic pulse generating apparatus for actuating one or more slave motors, comprises at least one hydraulic master cylinder, which in use is connected to a slave motor by flexible tubing or otherwise.

The master cylinder is fitted with a reciprocating plunger which is operated by power actuated driving means, and the cylinder communicates with a hydraulic fluid reservoir which is maintained at a pressure intermediate the maximum and minimum pressures produced in the cylinder by operation of the plunger.

Manual control means are provided, to prevent the transmission of pressure pulses to the motor while the power actuated driving means continues to operate and for this purpose the master cylinder preferably communicates with a transfer chamber, the volumetric capacity of which is variable by operation of the manual control means.

Means are also provided whereby, when the capacity of the transfer chamber is thus increased beyond its normal capacity, the further inflow of fluid from the reservoir is prevented.

1 Claim, 6 Drawing Figures

HYDRAULIC PULSE GENERATING APPARATUS

This application, which is a division of application Ser. No. 549,053, filed Feb. 11, 1975 and now U.S. Pat. No. 3,988,828 relates to hydraulic pulse generating apparatus for actuating hydraulically operated shearing handpieces and other hydraulically operable tools and devices, especially hand held tools and devices.

Pulse generating apparatus according to the invention comprises a hydraulic master cylinder adapted to be connected to a slave motor, a plunger reciprocatingly mounted in the cylinder for actuation by power operated means, a hydraulic fluid reservoir communicating with the cylinder for the supply of liquid thereto, a spring-loaded plunger arranged to maintain the liquid in the reservoir under a pressure which is intermediate between the maximum and minimum pressures produced in the cylinder by operation of the plunger, and manual control means operable to interrupt the transmission of said pressure pulses to the motor while said power operated means continues to operate.

For the last mentioned purpose, the master cylinder preferably communicates with a transfer chamber, the volumetric capacity of which may be increased beyond its normal capacity by operation of manual control means whereby additional fluid may pass thereinto from the master cylinder, and for this purpose means are provided for preventing the further inflow of liquid from the reservoir when the capacity of the transfer chamber is thus increased.

Figure 1:
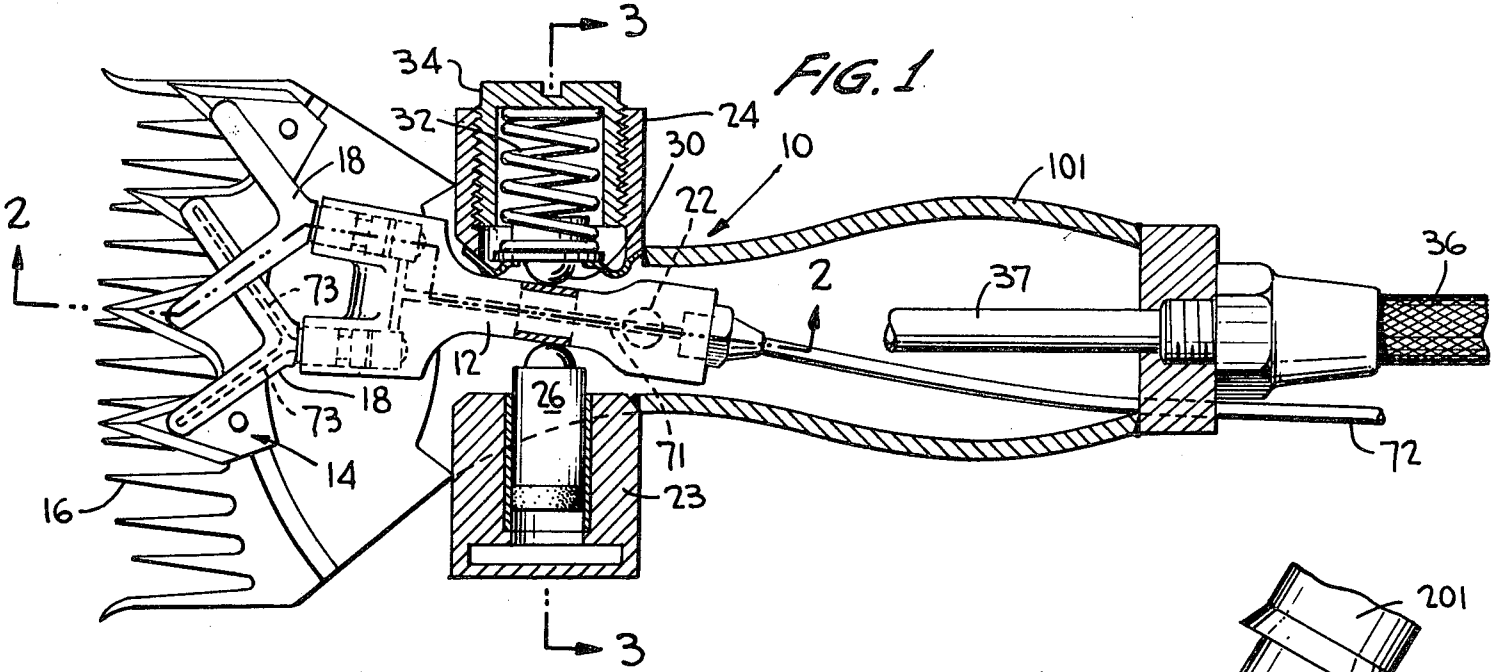

In the accompanying drawings:

FIG. 1 is a view in sectional plan of a hydraulically operated shearing handpiece.

Figure 2:
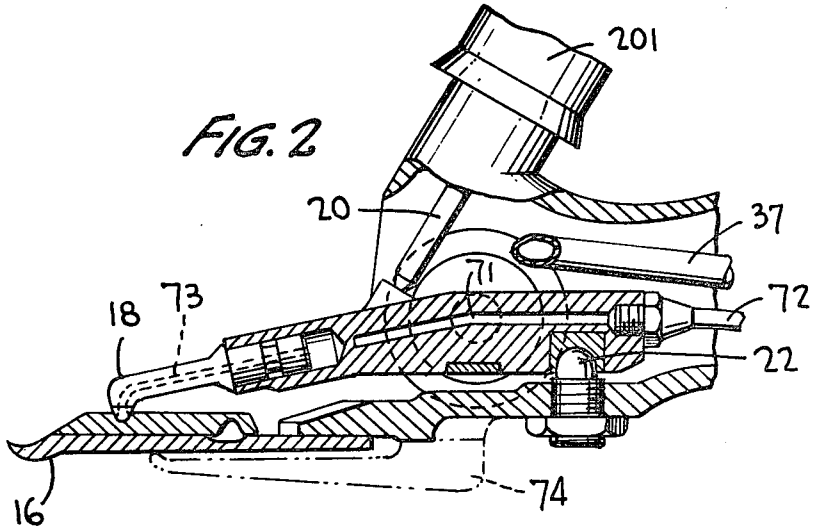
Figure 3:
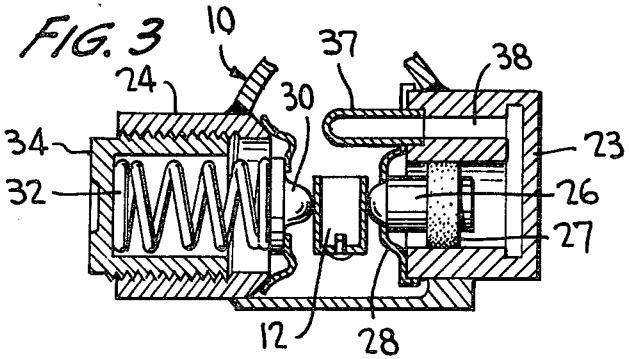
Figure 4:
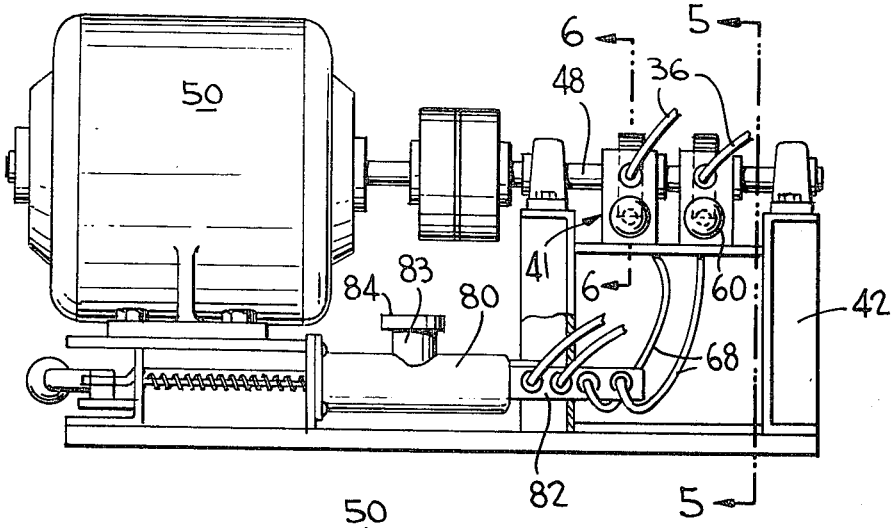
Figure 5:
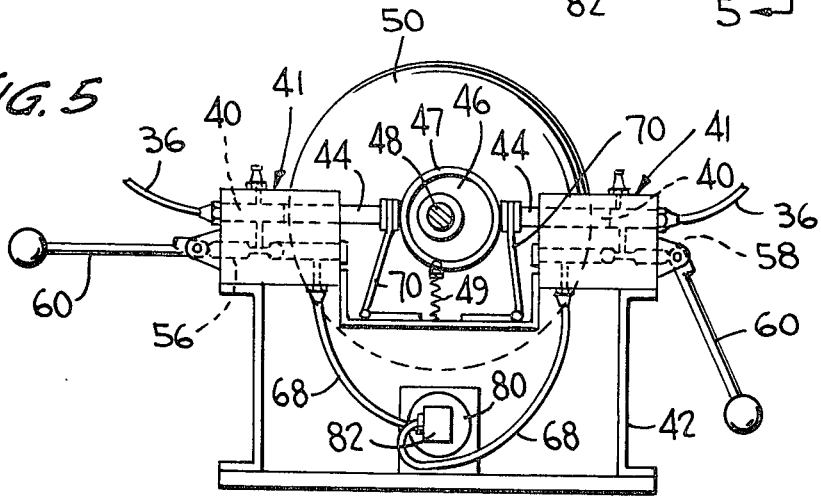
Figure 6:
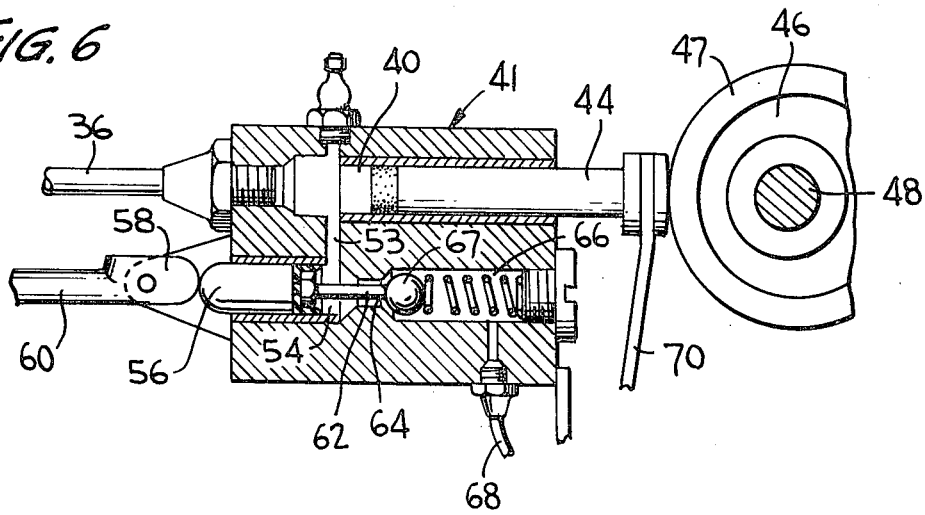

FIG. 2 is a view in sectional side elevation taken on the line 2—2 of FIG. 1, FIG. 3 is a view in sectional end elevation taken on the line 3—3 of FIG. 1 and shows a minor modification, FIG. 4 is a view in side elevation of one form of hydraulic pulse generating apparatus according to the invention, FIG. 5 is a view in sectional end elevation taken on the line 4—4 of FIG. 4, and FIG. 6 is a view in sectional end elevation taken on the line 6—6 of FIG. 4.

The hydraulic pulse generating apparatus shown in FIGS. 4, 5 and 6 comprises four master cylinders 40 each of which may be connected to the cylinder of a reciprocating hydraulic motor of a corresponding hand tool or other device, e.g. a shearing handpiece of the kind shown in FIGS. 1, 2 and 3, it being understood that any required number of cylinders 40 may be provided.

Each master cylinder 40 is formed horizontally in an individual cylinder block 41 mounted on a suitable base frame 42 and is fitted with a slidable plunger 44 which projects from one end thereof for actuation by an eccentric 46 mounted on a spindle 48 driven by an electric motor 50. Preferably and as shown, a ball race 47 is mounted on the periphery of the eccentric so that the outer ring thereof engages the plunger 14. In this way, friction and wear are reduced as the eccentric rotates freely within the said outer ring, the angular movement of which is restrained by an anchor spring 49 and so is constrained to gyrate about the rotational axis with minimum rubbing movement between it and the plungers 14.

In the illustrated construction, two cylinder blocks 41 are arranged side-by-side at each side of the spindle 48, each cylinder being co-axial with a corresponding cylinder at the opposite side of the spindle so that each eccentric 46 operates the plungers 44 of an opposed pair of cylinders.

Each cylinder 40 is connected within its respective block by a transverse passage 53 to the inner end of a parallel cylinder 54, herein termed a transfer cylinder, fitted with a slidable plunger 56 which projects therefrom and is engaged by any suitable adjustable stop member, e.g. by an angularly movable cam 58 secured to a pivoted manually operated control arm 60. The inner end of the plunger 56 is provided with an axial pin 62 which extends through a reduced neck 64 which connects the cylinder 54 to a co-axial bore 66 containing a spring loaded ball valve 67 which, when the plunger 56 is in its innermost position, as shown in FIG. 6, is held clear of its adjacent seating by the pin 62.

The bore 66 is connected by a lateral hole and a tube 68 to a reservoir of hydraulic fluid which is maintained under a substantially constant pressure. This reservoir may comprise a horizontal cylinder 80 secured to the base frame 42 and fitted with a manually retractible piston which normally maintains the liquid under a suitable pressure, e.g. by a spring-loaded linkage, the geometry of which is such that the pressure in the reservoir is substantially constant irrespective of the position of the piston therein. The closed outer end of the reservoir cylinder 80 communicates with a manifold 82 to which the supply tube 68 for each of the several master cylinders 40 is connected by a fitting which prevents or restricts reverse flow of fluid from the tube 68 to the reservoir.

Suitable provision is made for bleeding air from the hydraulic system which is thus normally full of hydraulic fluid, any leakage which may occur being automatically replaced from the reservoir cylinder which is provided with an upstanding filling tube 83 which is normally closed and sealed by a cap 84. The pressure maintained in the reservoir cylinder is less than the maximum but greater than the minimum pressure developed in the master cylinder by the reciprocating plunger 44, when the apparatus is in use, as hereinafter described, so that in the intervals between successive pressure pulses additional fluid may pass from the reservoir to the master cylinder to replace any leakage from the system.

From the preceding description, it will be understood that the pressure of the fluid normally maintains the plunger 44 of each master cylinder 40 in contact with the ballrace 47 on its respective eccentric 46, in opposition to a light strip spring 70 which tends to retract it. Consequently, when the motor 50 is operating normally, each plunger 40 makes one forward and one return stroke during each revolution of the eccentric and each outward stroke imparts a pressure pulse to the hydraulic fluid in the respective master cylinder, and this pulse is transmitted through a flexible tube 36 or the like which connects the outer end of the master cylinder to the cylinder of a reciprocating "slave" motor embodied in a hydraulically operated hand tool or other device, e.g. the shearing handpiece shown in FIGS. 1, 2 and 3 and hereinafter described. Thus the motor is constrained to operate in unison with the plunger 44 of the master cylinder.

However, if while the driving motor 50 continues to operate, the control arm 60 of any of the master cylinder assemblies is moved downwardly from its normal horizontal position shown at the left of FIG. 5 to the position shown at the right of that Figure, the hydraulic fluid displaced by the master plunger 44 during its next succeeding inward stroke passes through the transverse passage 53 into the transfer cylinder 54 and forces the plunger 56 outwardly to the extent permitted by the then retracted cam 58 on the control arm, while at the same time, the strip spring 70 withdraws the master plunger 54 through a distance at least equal to the throw of the eccentric 46.

When the plunger 56 is thus retracted the ball valve 67 engages its seating to prevent further inflow of fluid from the reservoir cylinder 80.

Consequently, while the control arm 60 is in its retracted position, the master plunger 44 remains stationary in its innermost position even though the eccentric continues to rotate, so that the respective handpiece ceases to operate.

However, by returning the control arm 60 to its normal horizontal, or operative, position, the hydraulic fluid previously transferred to the cylinder 54 is returned to the master cylinder 40. Thus the plunger 44 therein is again forced outwardly into contact with the eccentric 46 so that the respective hand piece again starts to operate.

It will be apparent also that operation of the control arm 60 in either direction does not result in the discharge of liquid from the hydraulic system which thus normally remains closed, though it may become necessary from time to time to replace liquid which has leaked therefrom.

Consequently, the operator of each handpiece is able to control the operation of his handpiece while the common driving motor operates continuously.

It will also be evident that each eccentric 46 may be replaced by a cam provided with two or more lobes arranged at equal angular intervals in which case two or more pressure pulses are transmitted to the respective handpieces during each rotation of the spindle 48.

The illustrated shearing handpiece which is more fully described in my aforesaid copending application Ser. No. 549,053, is generally similar in its main features to a conventional power operated handpiece, and comprises a hollow body 10, the rear portion of which forms an integral handgrip 101, and a longitudinally extending arm or fork 12 which is pivotally mounted on a vertically disposed domed pivot pin 22 fixed to the body and this pivoted fork is arranged to oscillate a toothed cutter 14 transversely across the face of a conventional comb 16 which is detachably secured to the forward end of the body and which forms a co-acting cutter member.

The body 10 is provided forwardly of the pivot pin 22, and on the opposite sides of the pivoted arm 12, with two transversely arranged coaxial cylinders comprising a hydraulic motor cylinder 23 which is closed at its outer end and a cylinder 24 which forms a housing for a helical compression return spring 32.

The hydraulic cylinder 23 is fitted with a slidable plunger 26 which is suitably sealed thereto and the inner end of this plunger projects from the cylinder and is formed centrally with a dome-shaped projection which bears against the adjacent side of the pivoted arm 12 which may be provided with a replaceable wear piece as shown.

In the modification shown in FIG. 3, the plunger 26 is substantially smaller in diameter than the cylinder and is sealed to the outer end portion of the latter by a relatively thick ring 27 formed of suitable resilient material which is permanently bonded to the plunger and the cylinder at its inner and outer peripheries respectively. Also, a resilient cover or "sock" 28 of suitable plastics material or rubber may enclose the outer end of the plunger as shown in this Figure.

The inner end of the compression spring 32 is fitted with a cap piece 30 formed with a domed projection for engagement with the respective side of the pivoted arm while the pressure exerted by the spring is adjusted by means of a spring abutment member 34 which has a screw threaded engagement in the outer end of its cylinder. The cap piece 30 may also be enclosed within a resilient plastic sock or the like to prevent the entry of wool and dust.

In use, the outer end of the motor cylinder 23 is filled with hydraulic fluid and is connected by the flexible tube 36 to the hydraulic pulse generating apparatus. In the illustrated construction this tube is connected to the rear end of the handgrip 101 as shown in FIG. 1 and is extended within the hollow handgrip by a tube 37, which may be either rigid or flexible, to the inner end of the cylinder 23 where it communicates with the adjacent end of a hole 38 which extends longitudinally through the cylinder wall to a cavity at the closed outer end of the cylinder as shown in FIG. 3.

The hydraulic motor comprising cylinder 23 and plunger 26, is thus a "slave" motor which is constrained to operate in unison with the plunger 44 of the corresponding master cylinder 40.

The return spring 32 and its housing cylinder 24 may, if desired, be replaced by a second hydraulic motor cylinder identical with the motor cylinder 23 in which case the plunger of this second motor cylinder is actuated in the manner hereinafter described by pressure pulses which are opposite in phase to those supplied to the cylinder 23 whereby as either motor plunger 26 is projected by a pressure pulse, the other is retracted.

I claim:

1. Hydraulic pulse generating apparatus comprising a hydraulic master cylinder adapted to be connected to a slave motor, means for providing continuous fluid communication between said master cylinder and the slave motor, a plunger reciprocable in the cylinder to produce successive pressure pulses in the liquid therein, power actuated driving means for the plunger, a hydraulic fluid reservoir communicating with the master cylinder for the supply thereto of fluid under a substantially constant base pressure which is intermediate between the maximum and minimum pressures produced in the master cylinder during operation, a transfer chamber of variable capacity which continuously communicates with the master cylinder, manual control means operable to increase the capacity of the transfer chamber beyond its normal operating capacity by an amount at least equal to the volume of liquid normally displaced by said plunger of the master cylinder whereby when its capacity is thus increased the fluid which is normally pulsed by the plunger towards the slave motor passes into the transfer chamber from the master cylinder thereby to interrupt the transmission of said pressure pulses to the slave motor while said power operated means continues to operate and the master cylinder continuously communicates with the motor, and including valve means for preventing the flow of additional fluid into the cylinder from the reservoir when the capacity of the transfer chamber is thus increased.

* * * * *